US005377486A

United States Patent [19]

Servati et al.

[11] Patent Number: 5,377,486

[45] Date of Patent: Jan. 3, 1995

[54] CATALYTIC CONVERTER SYSTEM

[75] Inventors: Hamid B. Servati, Farmington Hills; Steven T. Darr, Ypsilanti; Mary B. Furness, St. Clair Shores, all of Mich.

[73] Assignee: Ford Motor Company, Dearborn, Mich.

[21] Appl. No.: 61,466

[22] Filed: May 17, 1993

[51] Int. Cl.[6] ..... F01N 3/28

[52] U.S. Cl. ..... 60/288

[58] Field of Search ..... 60/274, 288

[56] References Cited

U.S. PATENT DOCUMENTS

| | | | |
|---|---|---|---|
| 3,440,817 | 4/1969 | Saufferer | 60/288 |
| 3,791,143 | 2/1974 | Keith | 60/288 |
| 4,817,385 | 4/1989 | Kumagai | 60/288 |
| 5,058,380 | 10/1991 | Pelters | 60/288 |
| 5,233,830 | 8/1993 | Takeshima | 60/288 |

FOREIGN PATENT DOCUMENTS

| | | | |
|---|---|---|---|
| 0556854A1 | 2/1993 | European Pat. Off. . | |
| 2420678 | 11/1975 | Germany | 60/288 |
| 107865 | 6/1983 | Japan | 60/288 |

OTHER PUBLICATIONS

Manual, 1993 Ranger/Explorer/Aerostar Powertrain/-Drivetrain, Aug. 1992, p. 09-00-8.

*Primary Examiner*—Douglas Hart

*Attorney, Agent, or Firm*—Roger L. May; Peter Abolins

[57] ABSTRACT

An apparatus for controlling temperatures of catalytic converters in an exhaust system of an internal combustion engine. The exhaust system includes a light-off catalytic converter and a main, or underbody, catalytic converter. The light-off catalytic converter is smaller and is disposed nearer to the engine than is the main catalytic converter so that it can be brought to an efficient operating temperature by engine exhaust gases in less time than can the main catalytic converter. This reduces the output of initial undesirable exhaust emissions during start-up periods when the engine and exhaust system components are relatively cold. A valve controls the flow of exhaust gases through each of the two catalytic converters to bring them most quickly to, and maintain them at, their most efficient operating temperatures.

8 Claims, 1 Drawing Sheet

Fig. 1
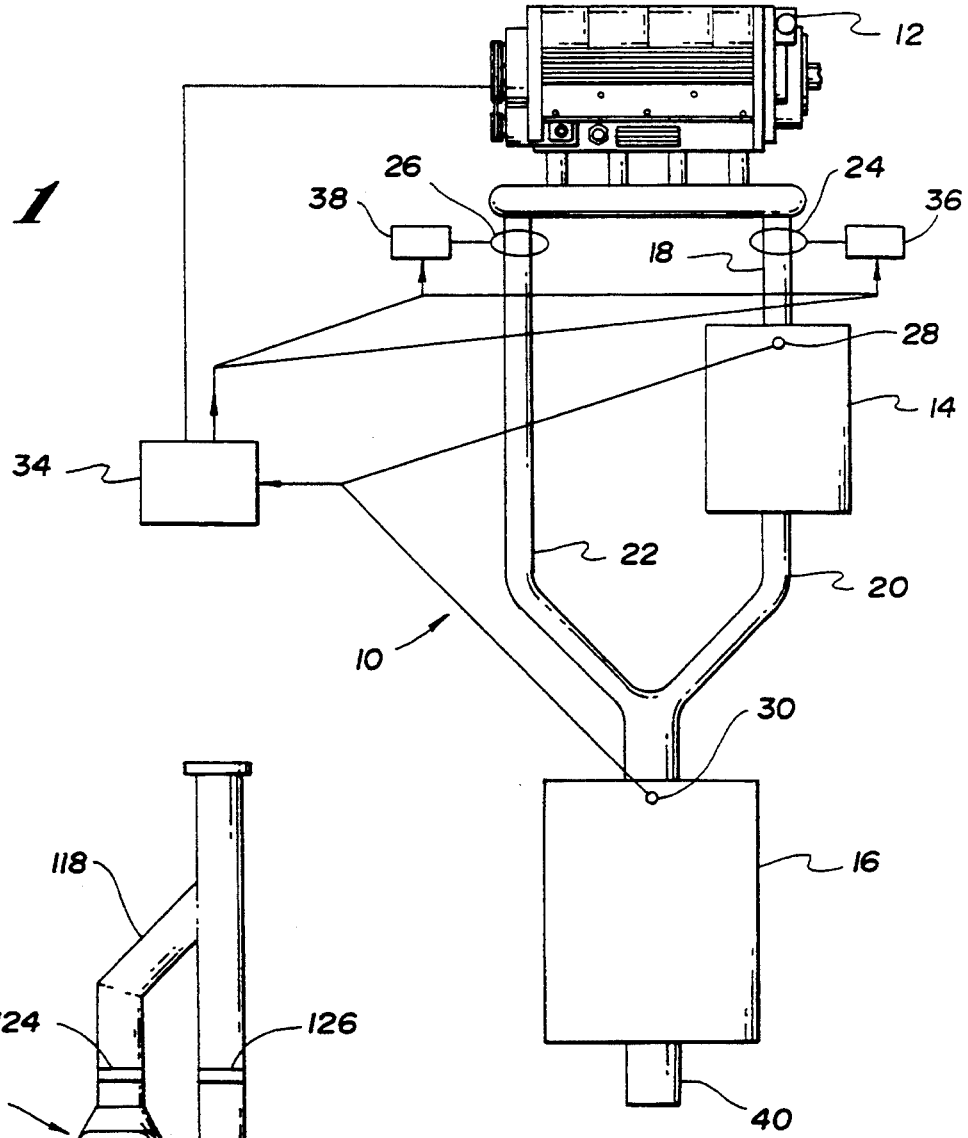
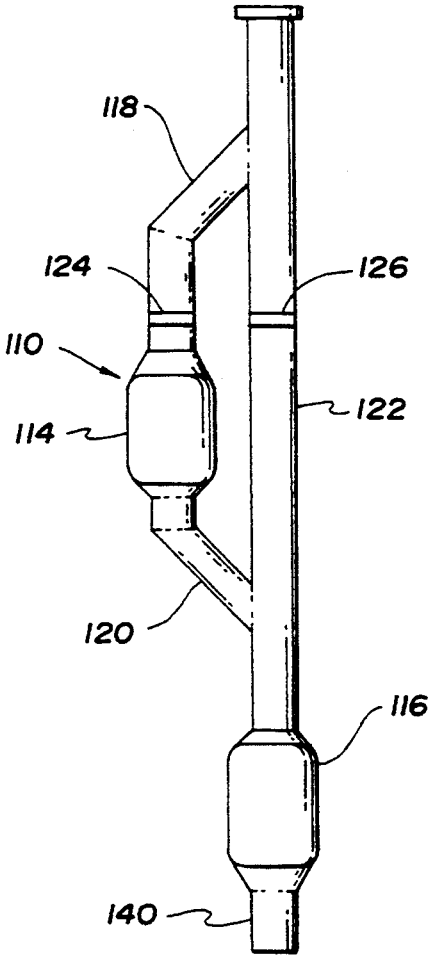
Fig. 2

CATALYTIC CONVERTER SYSTEM

TECHNICAL FIELD

This invention relates to catalytic converter systems for vehicles and more particularly to catalytic converter systems having a light-off catalytic converter and an underbody catalytic converter.

BACKGROUND OF INVENTION

Catalytic converters are used to reduce undesirable emissions in the exhaust gases of internal combustion vehicle engines and are located in exhaust systems connected to the engines. A catalytic conversion process operates most efficiently within a specific temperature range, and it is relatively inefficient when operating at a temperature below 800° F. (425° C.). Since a catalytic converter is relatively cool when an engine is initially started, it takes some time for the exhaust gases to heat the converter to its efficient operating temperature.

Light-off converters have been developed to minimize start-up emissions. Light-off converters are smaller and mounted in close proximity to the exhaust ports of the engine so that they heat quickly, due to their small size and proximity to the engine exhaust ports. A larger converter or underbody converter, is also used in conjunction with the light-off converter.

One problem is that catalytic converter elements may begin to breakdown at high temperatures; for example, catalytic converters can be damaged at temperatures not much above 1350° F. (735° C.). This problem is most pronounced in light-off catalytic converters due to their small size and close proximity to engine exhaust ports where temperatures may exceed 1400° F. (760° C.).

The problem addressed by this invention is that of providing bypassed a catalytic converter system that provides effect catalytic operation shortly after engine start-up and long term light-off catalytic converter durability by controlling the temperature of the catalyst in the light-off catalytic converter.

These and other objects and advantages are achieved by the invention as summarized below.

SUMMARY OF INVENTION

The present invention provides an apparatus for controlling temperatures of catalytic converters in an exhaust system of an internal combustion engine having a light-off catalytic converter and a main, or underbody, catalytic converter. The temperature of the light-off catalytic converter is quickly raised by directing exhaust gases therethrough until the temperature of the light-off catalytic converter reaches an efficient temperature for catalization. Subsequently, exhaust gases are directed to the main catalytic converter to prevent overheating of the light-off catalytic converter. An input exhaust gas conduit connects the light-off catalytic converter to the engine. An intermediate exhaust gas conduit connects the light-off catalytic converter to the main catalytic converter. A bypass exhaust gas conduit connects the main catalytic converter directly to the engine. The flow of the exhaust gas through the light-off catalytic converter and the main catalytic converter is controlled by signals indicative of the exhaust gas temperatures.

The signals may be sensed directly from thermocouples or may be signals representative of characteristic exhaust gas temperatures based upon time factors or dynamometer mapping data.

Signals representative of operating parameters of an engine may include signals from ignition spark advance controls, exhaust gas recirculation signals, and signals representative of air/fuel ratios, combustive air flow, engine coolant temperature, feed gas temperature, engine load, and engine rotational speed. A plurality of the above signals may be combined to develop a control strategy for controlling routing of hot exhaust gases through the light-off catalytic converter and the main catalytic converter.

The objects, features and advantages of the present invention are readily apparent from the following detailed description of the best mode, and certain alternative modes, for carrying out the invention when taken in connection with the accompanying drawings.

BRIEF DESCRIPTION OF THE DRAWINGS

FIG. 1 is schematic view showing the catalytic converter system of the present invention attached to an internal combustion engine.

FIG. 2 is an alternative embodiment of a catalytic converter system made in accordance with the present invention.

BEST MODE FOR CARRYING OUT THE INVENTION

Referring to FIG. 1, a first embodiment of the present invention is shown schematically wherein the catalytic converter system 10 is attached to an internal combustion engine 12. A light-off catalytic converter 14 and main catalytic converter 16, or underbody catalytic converter, are provided. An input exhaust gas conduit 18 connects the engine 12 to the light-off catalytic converter 14. An intermediate exhaust gas conduit 20 directs exhaust gas from the light-off catalytic converter 14 to the main catalytic converter 16. A bypass exhaust gas conduit 22 extends from the engine 12 to the main catalytic converter 16.

A light-off catalytic converter valve 24 is preferably provided in the input exhaust gas conduit 18. The light-off catalytic converter valve could also be located in the intermediate exhaust gas conduit 20. In either location, closing the light-off catalytic converter valve 24 stops the flow of exhaust gases through the light-off catalytic converter 14.

A bypass valve 26 is provided in the bypass gas conduit 22. Bypass valve 26 closes upon initial engine start-up so that all the hot exhaust gases from the engine 12 are directed through the light-off catalytic converter 14 causing it to reach an efficient catalyst operation temperature more rapidly than would be possible with the larger main catalytic converter 16. Exhaust gases, after leaving the light-off catalytic converter 14, are directed by the intermediate exhaust gas conduit 20 to the main catalytic converter 16 which is, in turn, heated by the exhaust gases.

According to one embodiment of the invention, thermocouples 28 and 30 may be provided to sense the temperature of the catalytic converter 14 and main catalytic converter 16 respectively. Thermocouples 28 and 30 provide information as to the temperature of the respective catalytic converters so that exhaust gases may be directed as appropriate to achieve a rapid heating of the catalytic converter system and thereby achieve lower emission levels. The thermocouples also provide data regarding the temperature of the catalytic converters for the purpose of minimizing degeneration of the catalyst by overheating.

An electronic engine control unit 34 has data available, such as engine speed, spark advance, exhaust gas recirculation operation, air/fuel ratio, combustive air flow, engine cooling temperature, feed gas temperature, engine load, etc. The electronic engine control unit 34 also receives data from the thermocouples 28 and 30.

The electronic engine control unit 34 operates valve actuators 36 and 38 in the input exhaust gas conduit 18 and bypass gas exhaust conduit 22 respectively. Valves 24 and 26 are preferably butterfly valves but could be another type of valve. Butterfly valves are well suited to this exhaust application, because they provide minimum gas flow resistance when open, and are very effective at closing an exhaust gas pipe if desired. The bypass exhaust valve 26 is preferably spring-biased to a normally open position so that an interruption of control of the system would not interfere with engine operation.

After the exhaust gases have passed through one or both of the catalytic converters, the exhaust gases are directed to the muffler or other exhaust system elements by means of a tailpipe 40.

Referring now to FIG. 2, an alternative embodiment of the invention is shown as catalytic converter system 110. A light-off catalytic converter 114 and main catalytic converter 116 are interconnected by input exhaust gas conduit 118 and intermediate exhaust gas conduit 120. Bypass exhaust gas conduit 122 is a pipe leading directly to the main catalytic converter 116. A light-off catalytic converter valve 124 is provided in the input exhaust gas conduit 118, and a bypass valve 126 is provided in the bypass exhaust gas conduit 122. After passing through the main, or underbody, catalytic converter 116, gases are directed to a tailpipe 140. Control of the valves 124 and 126 is provided by the same mechanism as described with reference to FIG. 1.

The control strategy utilized by the valve controller in one form would include a start mode, lug mode, idle mode, and wide-open throttle mode. If none of the conditions exist, the catalytic converter system valve may be programmed to set the light-off and bypass catalyst valves based upon parameters of speed and load. Alternatively, the settings of the light-off and bypass catalyst valves may be set to duty cycle parameters keyed to the time of engine operation and time period during which the light-off and bypass valves are open.

The light-off catalyst preferably is equipped with a normally closed valve, and a normally open valve is normally provided for the bypass. By providing a normally closed valve for the light-off and a normally open valve for the bypass, interruption of control would not stop exhaust gas flow and would not allow overheating of the light-off catalyst. The light-off catalyst is preferably mounted in a close-coupled relationship to the engine.

While the best mode for carrying out the invention has been described in detail, those familiar with the art to which this invention relates will recognize various designs and embodiments for practicing the invention as defined by the following claims.

We claim:

1. An apparatus for controlling catalytic converter exhaust gas temperatures in an exhaust system of an internal combustion engine, the apparatus comprising:

at least one light-off catalytic converter;

at least one main catalytic converter;

an input exhaust gas conduit connecting the at least one light-off catalytic converter to an engine;

an intermediate exhaust gas conduit connecting the at least one light-off catalytic converter to the at least one main catalytic converter;

a bypass exhaust gas conduit connecting the at least one main catalytic converter to the engine;

light-off catalytic converter valve means for controlling exhaust gas flow from the engine only through the at least one light-off catalytic converter, said light-off catalytic converter valve means comprising an electrically controlled valve;

bypass valve means for controlling exhaust gas flow from the engine only through the bypass exhaust gas conduit, said bypass valve means comprising an electrically controlled valve;

means for generating signals representative of exhaust gas temperatures in the light-off catalytic converter;

means for generating signals representative of exhaust gas temperatures in the main catalytic converter;

means for generating signals representative of operating parameters of the engine;

engine control means for receiving the signals representative of exhaust gas temperatures in the light-off catalytic converter, the signals representative of exhaust gas temperatures in the main catalytic converter, and the signals representative of operating parameters of the engine and for generating in response thereto valve control signals for controlling the light-off catalytic converter valve means and the bypass valve means to direct the exhaust gas flow from the engine between the light-off catalytic converter and the bypass conduit varying proportionally therebetween from deminimus flow through the light-off catalytic converter and full flow through the bypass conduit to full flow through the light-off catalytic converter and deminimus flow through the bypass conduit, thereby controlling the exhaust gas temperatures in the light-off catalytic converter and in the main catalytic converter; and wherein the light-off catalytic converter valve means is resiliently biased to a normally closed position and the bypass valve means is resiliently biased to a normally open position, thereby ensuring an exhaust gas flow path through the bypass exhaust gas conduit in the event of a loss of valve control signals.

2. The apparatus defined by claim 1, wherein the light-off catalytic converter valve means is disposed in the input exhaust gas conduit.

3. The apparatus defined by claim 1, wherein the light-off catalytic converter valve means is disposed in the intermediate exhaust gas conduit.

4. The apparatus defined by claim 1, wherein:

the means for generating signals representative of exhaust gas temperatures in the light-off catalytic converter include a thermocouple disposed in the light-off catalytic converter; and the means for generating signals representative of exhaust gas temperatures in the main catalytic converter include a thermocouple disposed in the main catalytic converter.

5. The apparatus defined by claim 1, wherein the means for generating signals representative of exhaust gas temperatures in the light-off catalytic converter and for generating signals representative of exhaust gas temperatures in the main catalytic converter include a mapping device using predetermined dynamometer data.

6. An apparatus for controlling catalytic converter exhaust gas temperatures in an exhaust system of an internal combustion engine, the apparatus comprising:

at least one light-off catalytic converter;

at least one main catalytic converter;

an input exhaust gas conduit connecting the at least one light-off catalytic converter to an engine;

an intermediate exhaust gas conduit connecting the at least one light-off catalytic converter to the at least one main catalytic converter;

a bypass exhaust gas Conduit connecting the at least one main catalytic converter to the engine;

light-off catalytic converter valve means for controlling exhaust gas flow from the engine only through the at least one light-off catalytic converter;

bypass valve means for controlling exhaust gas flow from the engine only through the bypass exhaust gas conduit;

means for generating signals representative of exhaust gas temperatures in the light-off catalytic converter including means for determining the amount of ignition spark advance and for generating signals representative thereof, means for determining the amount of exhaust gas recirculation and for generating signals representative thereof, means for determining the ratio of air to fuel and for generating signals representative thereof, and means for determining the amount of combustive air flow and for generating signals representative thereof;

means for generating signals representative of exhaust gas temperatures in the main catalytic converter;

means for generating Signals representative of operating parameters of the engine; and engine control means for receiving the signals representative of exhaust gas temperatures in the light-off catalytic converter, the signals representative of exhaust gas temperatures in the main catalytic converter, and the signals representative of operating parameters of the engine and for generating in response thereto valve control signals for controlling the light-off catalytic converter valve means and the bypass valve means to proportionally direct the exhaust gas flow from the engine between the light-off catalytic converter and the bypass conduit in relative proportions ranging from no flow through the light-off catalytic converter with all exhaust gas being directed through the bypass conduit to all exhaust gas being directed through the light-off catalytic converter and no flow through the bypass conduit, thereby controlling the exhaust gas temperatures in the light-off catalytic converter and in the main catalytic converter.

7. The apparatus defined by claim 6, wherein the means for generating signals representative of operating parameters of the engine further include:

means for determining engine coolant temperature and for generating signals representative thereof;

means for determining feed gas temperature and for generating signals representative thereof;

means for determining engine load and for generating signals representative thereof; and means for determining engine rotational speed and for generating signals representative thereof.

8. The apparatus defined by claim 6, wherein the engine control means is an electronic engine control unit.

* * * * *